US009290016B2

(12) United States Patent
Landa et al.

(10) Patent No.: US 9,290,016 B2
(45) Date of Patent: Mar. 22, 2016

(54) PRINTING SYSTEM

(71) Applicant: LANDA CORPORATION LTD., Rehovot (IL)

(72) Inventors: Benzion Landa, Nes Ziona (IL); Aharon Shmaiser, Rishon LeZion (IL); Itshak Ashkanazi, Rehovot (IL)

(73) Assignee: LANDA CORPORATION LTD., Rehovot ( * ) Notice: Subject to any disclaimer, the term of this patent is extended or adjusted under 35 U.S.C. 154(b) by 0 days.

(21) Appl. No.: 14/382,758

(22) PCT Filed: Mar. 5, 2013

(86) PCT No.: PCT/IB2013/051718

§ 371 (c)(1),
(2) Date: Sep. 3, 2014

(87) PCT Pub. No.: WO2013/132420

PCT Pub. Date: Sep. 12, 2013

(65) Prior Publication Data

US 2015/0022602 A1 Jan. 22, 2015

Related U.S. Application Data

(60) Provisional application No. 61/606,913, filed on Mar. 5, 2012, provisional application No. 61/611,286, filed (Continued)

(51) Int. Cl.
*B41J 2/01* (2006.01)
*B41J 11/00* (2006.01)

(Continued)

(52) U.S. Cl.
CPC *B41J 11/002* (2013.01); *B41J 2/01* (2013.01); *G03G 15/0189* (2013.01); *G03G 15/1605* (2013.01); *B41J 2002/012* (2013.01); *G03G 2215/0129* (2013.01)

(58) Field of Classification Search
CPC ..... B41J 11/002; B41J 2/01; B41J 2002/012; G03G 15/0189; G03G 15/1605; G03G 2215/0129
USPC ..... 347/102
See application file for complete search history.

(56) References Cited

U.S. PATENT DOCUMENTS 3,898,670 A 8/1975 Erikson et al.
4,009,958 A 3/1977 Kurita et al.

(Continued)

FOREIGN PATENT DOCUMENTS

DE 102010060999 A 6/2012
JP 2002169383 A 6/2002

(Continued)

OTHER PUBLICATIONS

DE 102010060999 Machine Translation (by EPO and Google)—published Jun. 6, 2012; Wolf, Roland, Dr.-Ing.

(Continued)

*Primary Examiner* — Stephen Meier
*Assistant Examiner* — Alexander D Shenderov
(74) *Attorney, Agent, or Firm* — Marc Van Dyke; Fourth Dimension IP

(57) ABSTRACT

A printing system is disclosed which comprises an image forming station 12 at which an ink that includes an organic polymeric resin and a coloring agent is applied to an outer surface of an intermediate transfer member 10 to form an ink image, a drying station 14 for drying the ink image to leave a residue film of resin and coloring agent; and an impression station 16 at which the residue film is transferred to a substrate. The intermediate transfer member 10 comprises a thin flexible substantially inextensible belt and the impression station 16 comprises an impression cylinder 20 and a pressure cylinder 18 having a compressible outer surface for urging the belt against the impression cylinder to cause the residue film resting on the outer surface of the belt 10 to be transferred onto a substrate passing between the belt 10 and the impression cylinder 20 during engagement with the pressure cylinder. The belt 10 has a length greater than the circumference of the pressure cylinder 18 and is guided to contact the pressure cylinder over only a portion of its length.

20 Claims, 2 Drawing Sheets

Related U.S. Application Data on Mar. 15, 2012, provisional application No. 61/611,505, filed on Mar. 15, 2012, provisional application No. 61/619,546, filed on Apr. 3, 2012, provisional application No. 61/635,156, filed on Apr. 18, 2012, provisional application No. 61/640,493, filed on Apr. 30, 2012.

(51) Int. Cl.
*G03G 15/01* (2006.01)
*G03G 15/16* (2006.01)

(56) References Cited

U.S. PATENT DOCUMENTS 4,093,764 A 6/1978 Duckett et al.
4,535,694 A 8/1985 Fukuda
4,538,156 A 8/1985 Durkee et al.
4,976,197 A 12/1990 Yamanari et al.
5,012,072 A 4/1991 Martin et al.
5,099,256 A 3/1992 Anderson
5,305,099 A 4/1994 Morcos
5,352,507 A 10/1994 Bresson et al.
5,406,884 A 4/1995 Okuda et al.
5,471,233 A 11/1995 Okamoto et al.
5,552,875 A 9/1996 Sagiv et al.
5,587,779 A * 12/1996 Heeren et al. ..... 399/308
5,613,669 A 3/1997 Grueninger
5,614,933 A 3/1997 Hindman et al.
5,623,296 A 4/1997 Fujino et al.
5,660,108 A 8/1997 Pensavecchia
5,677,719 A 10/1997 Granzow
5,698,018 A 12/1997 Bishop et al.
5,841,456 A 11/1998 Takei et al.
5,884,559 A 3/1999 Okubo et al.
5,978,631 A 11/1999 Lee
6,009,284 A 12/1999 Weinberger et al.
6,024,018 A 2/2000 Darel et al.
6,033,049 A 3/2000 Fukuda
6,055,396 A * 4/2000 Pang ..... 399/164
6,059,407 A 5/2000 Komatsu et al.
6,102,538 A 8/2000 Ochi et al.
6,108,513 A 8/2000 Landa et al.
6,195,112 B1 2/2001 Fassler et al.
6,196,674 B1 3/2001 Takemoto
6,213,580 B1 4/2001 Segerstrom et al.
6,234,625 B1 5/2001 Wen
6,303,215 B1 10/2001 Sonobe et al.
6,354,700 B1 3/2002 Roth
6,363,234 B2 3/2002 Landa et al.
6,364,451 B1 4/2002 Silverbrook
6,386,697 B1 5/2002 Yamamoto et al.
6,390,617 B1 5/2002 Iwao
6,402,317 B2 6/2002 Yanagawa et al.
6,409,331 B1 6/2002 Gelbart
6,438,352 B1 8/2002 Landa et al.
6,454,378 B1 9/2002 Silverbrook et al.
6,530,657 B2 3/2003 Polierer
6,559,969 B1 5/2003 Lapstun
6,575,547 B2 6/2003 Sakuma
6,608,979 B1 8/2003 Landa et al.
6,639,527 B2 10/2003 Johnson
6,648,468 B2 11/2003 Shinkoda et al.
6,678,068 B1 1/2004 Richter et al.
6,682,189 B2 1/2004 May et al.
6,704,535 B2 3/2004 Kobayashi et al.
6,719,423 B2 4/2004 Chowdry et al.
6,755,519 B2 6/2004 Gelbart et al.
6,761,446 B2 7/2004 Chowdry et al.
6,789,887 B2 9/2004 Yang et al.
6,827,018 B1 12/2004 Hartmann et al.
6,898,403 B2 * 5/2005 Baker et al. ..... 399/249
6,912,952 B1 7/2005 Landa et al.
6,917,437 B1 7/2005 Myers et al.
6,970,674 B2 11/2005 Sato et al.
6,974,022 B2 12/2005 Saeki
6,982,799 B2 1/2006 Lapstun
7,057,760 B2 6/2006 Lapstun et al.
7,204,584 B2 4/2007 Lean et al.
7,224,478 B1 5/2007 Lapstun et al.
7,296,882 B2 11/2007 Buehler et al.
7,300,133 B1 11/2007 Folkins et al.
7,300,147 B2 11/2007 Johnson
7,304,753 B1 12/2007 Richter et al.
7,322,689 B2 1/2008 Kohne et al.
7,360,887 B2 4/2008 Konno
7,362,464 B2 4/2008 Kitazawa
7,459,491 B2 12/2008 Tyvoll et al.
7,527,359 B2 5/2009 Stevenson et al.
7,708,371 B2 5/2010 Yamanobe
7,712,890 B2 5/2010 Yahiro
7,808,670 B2 10/2010 Lapstun et al.
7,810,922 B2 10/2010 Gervasi et al.
7,845,788 B2 12/2010 Oku
8,025,389 B2 9/2011 Yamanobe et al.
8,042,906 B2 10/2011 Chiwata et al.
8,059,309 B2 11/2011 Lapstun
8,109,595 B2 2/2012 Tanaka et al.
8,147,055 B2 4/2012 Cellura et al.
8,256,857 B2 9/2012 Folkins et al.
8,264,135 B2 9/2012 Ozolins et al.
8,295,733 B2 10/2012 Imoto
8,303,072 B2 11/2012 Shibata et al.
8,693,032 B2 4/2014 Goddard et al.
8,711,304 B2 4/2014 Mathew et al.
8,746,873 B2 6/2014 Tsukamoto et al.
8,894,198 B2 11/2014 Hook et al.
8,919,946 B2 12/2014 Suzuki et al.
2001/0022607 A1 9/2001 Takahashi et al.
2003/0004025 A1 * 1/2003 Okuno et al. ..... 474/260
2003/0067529 A1 * 4/2003 May et al. ..... 347/103
2003/0118381 A1 6/2003 Law et al.
2003/0214568 A1 11/2003 Nishikawa et al.
2003/0234849 A1 12/2003 Pan et al.
2004/0228642 A1 * 11/2004 Iida et al. ..... 399/27
2005/0082146 A1 4/2005 Axmann
2005/0110855 A1 5/2005 Taniuchi et al.
2005/0134874 A1 6/2005 Overall et al.
2005/0150408 A1 7/2005 Hesterman
2006/0164488 A1 7/2006 Taniuchi et al.
2007/0014595 A1 * 1/2007 Kawagoe ..... 399/301
2007/0134030 A1 6/2007 Lior et al.
2007/0146462 A1 6/2007 Taniuchi et al.
2007/0176995 A1 8/2007 Kadomatsu et al.
2007/0229639 A1 10/2007 Yahiro
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0043082 A1 2/2008 Yahiro
2008/0055381 A1 3/2008 Doi et al.
2008/0055385 A1 3/2008 Houjou
2008/0074462 A1 3/2008 Hirakawa
2008/0166495 A1 7/2008 Maeno et al.
2008/0196612 A1 8/2008 Rancourt et al.
2008/0196621 A1 8/2008 Ikuno et al.
2009/0022504 A1 1/2009 Kuwabara et al.
2009/0080949 A1 3/2009 Yamanobe et al.
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0317555 A1 12/2009 Hori
2010/0066796 A1 3/2010 Yanagi et al.
2010/0075843 A1 3/2010 Ikuno et al.
2010/0091064 A1 4/2010 Araki et al.
2010/0303504 A1 12/2010 Funamoto et al.
2010/0310281 A1 12/2010 Miura et al.
2011/0058001 A1 3/2011 Gila et al.
2011/0085828 A1 4/2011 Kosako et al.
2011/0141188 A1 6/2011 Morita
2011/0234683 A1 9/2011 Komatsu
2011/0234689 A1 9/2011 Saito
2011/0269885 A1 11/2011 Imai

(56) References Cited

U.S. PATENT DOCUMENTS

| | | | |
|---|---|---|---|
| 2012/0013928 | A1 | 1/2012 | Yoshida et al. |
| 2012/0026224 | A1 | 2/2012 | Anthony et al. |
| 2012/0039647 | A1 | 2/2012 | Brewington et al. |
| 2012/0105525 | A1 | 5/2012 | Leung et al. |
| 2012/0105561 | A1 | 5/2012 | Taniuchi et al. |
| 2012/0113203 | A1 | 5/2012 | Kushida et al. |
| 2012/0127250 | A1 | 5/2012 | Kanasugi et al. |
| 2012/0140009 | A1 | 6/2012 | Kanasugi et al. |
| 2012/0194830 | A1 | 8/2012 | Gaertner et al. |
| 2012/0237260 | A1 | 9/2012 | Sengoku et al. |
| 2015/0022602 | A1 | 1/2015 | Landa et al. |
| 2015/0024648 | A1 | 1/2015 | Landa et al. |
| 2015/0042736 | A1 | 2/2015 | Landa et al. |
| 2015/0049134 | A1 | 2/2015 | Shmaiser et al. |
| 2015/0054865 | A1 | 2/2015 | Landa et al. |

FOREIGN PATENT DOCUMENTS

| | | | |
|---|---|---|---|
| JP | 2002326733 | A | 11/2002 |
| JP | 2003114558 | A | 4/2003 |
| JP | 2003211770 | A | 7/2003 |
| JP | 2004114377 | A | 4/2004 |
| JP | 2004114675 | A | 4/2004 |
| JP | 2005014255 | A | 1/2005 |
| JP | 2006102975 | A | 4/2006 |
| JP | 2006137127 | A | 6/2006 |
| JP | 2006347081 | A | 12/2006 |
| JP | 2007069584 | A | 3/2007 |
| JP | 2007216673 | A | 8/2007 |
| JP | 2008142962 | A | 6/2008 |
| JP | 2008255135 | A | 10/2008 |
| JP | 2009045794 | A | 3/2009 |
| JP | 2009083317 | A | 4/2009 |
| JP | 2009083325 | A | 4/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009226852 | A | 10/2009 |
| JP | 2009233977 | A | 10/2009 |
| JP | 2009234219 | A | 10/2009 |
| JP | 2010105365 | A | 5/2010 |
| JP | 2010173201 | A | 8/2010 |
| JP | 2010241073 | A | 10/2010 |
| JP | 2011025431 | A | 2/2011 |
| JP | 2011173325 | A | 9/2011 |
| JP | 2011173326 | A | 9/2011 |
| JP | 2012086499 | A | 6/2012 |
| JP | 2012111194 | A | 6/2012 |
| WO | WO9307000 | | 4/1993 |
| WO | WO2013087249 | A1 | 6/2013 |
| WO | WO2013136220 | A1 | 9/2013 |

OTHER PUBLICATIONS

JP 2002-169383 Machine Translation (by EPO and Google)—published Jun. 14, 2002 Richo KK.
JP 2002-326733 Machine Translation (by EPO and Google)—published Dec. 11, 2002 Kyocera Mita Corp.
JP 2003-114558 Machine Translation (by EPO and Google)—published Apr. 18, 2003 Mitsubishi Chem Corp.
JP 2003-211770 Machine Translation (by EPO and Google)—published Jul. 29, 2003 Hitachi Printing Solutions.
JP 2004-114377 Machine Translation (by EPO and Google)—published Apr. 15, 2004; Konica Minolta Holdings Inc, et al.
JP 2004-114675 Machine Translation (by EPO and Google)—published Apr. 15, 2004; Canon Inc.
JP 2005-014255 Machine Translation (by EPO and Google)—published Jan. 20, 2005; Canon Inc.
JP 2006-102975 Machine Translation (by EPO and Google)—published Apr. 20, 2006; Fuji Photo Film Co Ltd.
JP 2006-137127 Machine Translation (by EPO and Google)—published Jun. 1, 2006; Konica Minolta Med & Graphic.
JP 2006-347081 Machine Translation (by EPO and Google)—published Dec. 28, 2006; Fuji Xerox.
JP 2007-069584 Machine Translation (by EPO and Google)—published Mar. 22, 2007 Fuji Film.
JP 2007-216673 Machine Translation (by EPO and Google)—published Aug. 30, 2007 Brother Ind.
JP 2008-142962 Machine Translation (by EPO and Google)—published Jun. 26, 2008; Fuji Xerox Co Ltd.
JP 2008-255135 Machine Translation (by EPO and Google)—published Oct. 23, 2008; Fujifilm Corp.
JP 2009-045794 Machine Translation (by EPO and Google)—published Mar. 5, 2009; Fujifilm Corp.
JP 2009-083317 Abstract; Machine Translation (by EPO and Google)—published Apr. 23, 2009; Fujifilm Corp.
JP 2009-083325 Machine Translation (by EPO and Google)—published Apr. 23, 2009 Fujifilm.
JP 2009-154330 Machine Translation (by EPO and Google)—published Jul. 16, 2009; Seiko Epson Corp.
JP 2009-190375 Machine Translation (by EPO and Google)—published Aug. 27, 2009; Fuji Xerox Co Ltd.
JP 2009-202355 Machine Translation (by EPO and Google)—published Sep. 10, 2009; Fuji Xerox Co Ltd.
JP 2009-214318 Machine Translation (by EPO and Google)—published Sep. 24, 2009 Fuji Xerox Co Ltd.
JP 2009-226852 Machine Translation (by EPO and Google)—published Oct. 8, 2009; Fujifilm Corp.
JP 2009-233977 Machine Translation (by EPO and Google)—published Oct. 15, 2009; Fuji Xerox Co Ltd.
JP 2009-234219 Machine Translation (by EPO and Google)—published Oct. 15, 2009; Fujifilm Corp.
JP 2010-105365 Machine Translation (by EPO and Google)—published May 13, 2010; Fuji Xerox Co Ltd.
JP 2010-173201 Abstract; Machine Translation (by EPO and Google)—published Aug. 12, 2010; Richo Co Ltd.
JP 2010-241073 Machine Translation (by EPO and Google)—published Oct. 28, 2010; Canon Inc.
JP 2011-025431 Machine Translation (by EPO and Google)—published Feb. 10, 2011; Fuji Xerox Co Ltd.
JP 2011-173325 Abstract; Machine Translation (by EPO and Google)—published Sep. 8, 2011; Canon Inc.
JP 2011-173326 Machine Translation (by EPO and Google)—published Sep. 8, 2011; Canon Inc.
JP 2012-086499 Machine Translation (by EPO and Google)—published May 10, 2012; Canon Inc.
JP 2012-111194 Machine Translation (by EPO and Google)—published Jun. 14, 2012; Konica Minolta.
International Search Report for PCT/NL1991/00190 published as WO 1993/007000.
WO 2013/087249 Machine Translation (by EPO and Google)—published Jun. 20, 2013; Koenig & Bauer AG.
International Search Report for PCT/IB2013/051719 published as WO 2013/136220.
Office Action for U.S. Appl. No. 14/382,758 dated Feb. 27, 2015.
Office Action for U.S. Appl. No. 14/340,122 dated Feb. 27, 2015.
International Search Report for PCT/IB2013/051718 published as WO 2013/132420.
Written Opinion for PCT/IB2013/051718 published as WO 2013/132420.

* cited by examiner

PRINTING SYSTEM

CROSS-REFERENCE TO RELATED APPLICATIONS

The present application is a National Phase of PCT Patent Application No. PCT/IB2013/051718 having International filing date of Mar. 5, 2013.

Co-pending PCT Application No. PCT/IB2013/051716 claiming priority from U.S. Provisional Patent Application No. 61/606,913, both incorporated herein by reference, disclose a printing process which comprises directing droplets of an ink onto an intermediate transfer member to form an ink image, the ink including an organic polymeric resin and a coloring agent (e.g. a pigment or a dye) in an aqueous carrier. The intermediate transfer member, which can be a belt or a drum, has a hydrophobic outer surface whereby each ink droplet spreads on impinging upon the intermediate transfer member to form an ink film. Steps are taken to counteract the tendency of the ink film formed by each droplet to contract and to form a globule on the intermediate transfer member, without causing each ink droplet to spread by wetting the surface of the intermediate transfer member. The ink image is next heated while being transported by the intermediate transfer member, to evaporate the aqueous carrier from the ink image and leave behind a residue film of resin and coloring agent which is then transferred onto a substrate.

FIELD OF THE INVENTION

The present invention relates to a printing system.

BACKGROUND OF THE INVENTION

The present invention is concerned with the construction of an intermediate transfer member that may be employed in such a printing process but may also find application in other offset printing systems. The intermediate transfer member described in the aforementioned applications may be a continuous loop belt which comprises a flexible blanket having a release layer, with a hydrophobic outer surface, and a reinforcement layer. The intermediate transfer member may also comprise additional layers to provide conformability of the release layer to the surface of the substrate, e.g. a compressible layer and a conformational layer, to act as a thermal reservoir or a thermal partial barrier, to allow an electrostatic charge to the applied to the release layer, to connect between the different layers forming the overall cohesive/integral blanket structure, and/or to prevent migration of molecules there-between. An inner layer can further be provided to control the frictional drag on the blanket as it is rotated over its support structure.

SUMMARY OF THE INVENTION

According to a first aspect of the present invention, there is provided a printing system comprising an image forming station at which droplets of an ink that include an organic polymeric resin and a coloring agent in an aqueous carrier are applied to an outer surface of an intermediate transfer member to form an ink image, a drying station for drying the ink image to leave a residue film of resin and coloring agent; and an impression station at which the residue film is transferred to a substrate, wherein the intermediate transfer member comprises a thin flexible substantially inextensible belt and wherein the impression station comprises an impression cylinder and a pressure cylinder having a compressible outer surface for urging the belt against the impression cylinder, during engagement with the pressure cylinder, to cause the residue film resting on the outer surface of the belt to be transferred onto a substrate passing between the belt and the impression cylinder, the belt having a length greater than the circumference of the pressure cylinder and being guided to contact the pressure cylinder over only a portion of the length of the belt.

In some embodiments of the invention, the belt is driven independently of the pressure cylinder.

In the present invention, the belt passing through the image forming station is a thin, light belt of which the speed and tension can be readily regulated. Slack runs of the belt may be provided between the impression station and the image forming station to ensure that any vibration imposed on the movement of the belt while passing through the impression station should be effectively isolated from the run of the belt in the image forming station.

At the impression station, the compressible blanket on the pressure cylinder can ensure intimate contact between the belt and the surface of the substrate for an effective transfer of the ink residue film onto the substrate.

In some embodiments of the invention, the belt comprises a reinforcement or support layer coated with a release layer. The reinforcement layer may be of a fabric that is fiber-reinforced so as to be substantially inextensible lengthwise. By "substantially inextensible", it is meant that during any cycle of the belt, the distance between any two fixed points on the belt will not vary to an extent that will affect the image quality. The length of the belt may however vary with temperature or, over longer periods of time, with ageing or fatigue. In one embodiment, the elongation of the belt in its longitudinal direction (e.g. parallel to the direction of movement of the belt from the image forming station to the impression station) is of at most 1% as compared to the initial length of the belt, or of at most 0.5%, or of at most 0.1%. In its width ways direction, the belt may have a small degree of elasticity to assist it in remaining taut and flat as it is pulled through the image forming station. The elasticity of the belt is hence substantially greater in the lateral direction as compared to the longitudinal direction. A suitable fabric may, for example, have high performance fibers (e.g. aramid, carbon, ceramic or glass fibers) in its longitudinal direction woven, stitched or otherwise held with cotton fibers in the perpendicular direction, or directly embedded or impregnated in the rubber forming the belt. A reinforcement layer, and consequently a belt, having different physical and optionally chemical properties in its length and width directions is said to be anisotropic. Alternatively, the difference in "elasticity" between the two perpendicular directions of the belt strip can be achieved by securing to a lateral edge of the belt an elastic strip providing the desired degree of elasticity even when using an isotropic support layer being substantially inextensible also in its width direction.

To assist in guiding the belt and prevent it from meandering, it is desirable to provide a continuous flexible bead of greater thickness than the belt, or longitudinally spaced formations, along the two lateral edges of the belt that can engage in lateral guide channels or tracks extending at least over the run of the belt passing through the image forming station and preferably also the run passing through the impression station. The distance between the channels may advantageously be slightly greater that the overall width of the belt, to maintain the belt under lateral tension.

To reduce the drag on the belt, the formations or bead on the lateral edges of the belt, in an embodiment of the invention, are retained within the channels by rolling bearings.

Lateral formations may conveniently be the teeth of one half of a zip fastener sewn, or otherwise secured, to each lateral edge of the belt. Such lateral formations need not be regularly spaced.

The belt is advantageously formed by a flat elongate strip of which the ends can be secured to one another to form a continuous loop. A zip fastener may be used to secure the opposite ends of the strip to one another so as to allow easy installation and replacement of the belt. The ends of the strip are advantageously shaped to facilitate guiding of the belt through the lateral channels and over the rollers during installation. Initial guiding of the belt into position may be done for instance by securing the leading edge of the belt strip introduced first in between the lateral channels to a cable which can be manually or automatically moved to install the belt. For example, one or both lateral ends of the belt leading edge can be releasably attached to a cable residing within each channel. Advancing the cable(s) advances the belt along the channel path. Alternatively or additionally, the edge of the belt in the area ultimately forming the seam when both edges are secured one to the other can have lower flexibility than in the areas other than the seam. This local "rigidity" may ease the insertion of the lateral formations of the belt strip into their respective channels.

Alternatively, the belt may be adhered edge to edge to form a continuous loop by soldering, gluing, taping (e.g. using Kapton® tape, RTV liquid adhesives or PTFE thermoplastic adhesives with a connective strip overlapping both edges of the strip), or any other method commonly known. Any previously mentioned method of joining the ends of the belt may cause a discontinuity, referred to herein as a seam, and it is desirable to avoid an increase in the thickness or discontinuity of chemical and/or mechanical properties of the belt at the seam. Preferably, no ink image or part thereof is deposited on the seam, but only as close as feasible to such discontinuity on an area of the belt having substantially uniform properties/characteristics.

In a further alternative, it is possible for the belt to be seamless.

The compressible blanket on the pressure cylinder in the impression station need not be replaced at the same time as the belt, but only when it has itself become worn.

As in a conventional offset litho press, the pressure cylinder and the impression cylinder are not fully rotationally symmetrical. In the case of the pressure cylinder, there is a discontinuity where the ends of the blanket are secured to the cylinder on which it is supported. In the case of the impression cylinder, there can also be a discontinuity to accommodate grippers serving to hold the sheets of substrate in position against the impression cylinder. The pressure cylinder and the impression cylinder rotate in synchronism so that the two discontinuities line up during cycles of the pressure cylinder. If the impression cylinder circumference is twice that of the pressure cylinder and has two sets of grippers, then the discontinuities line up twice every cycle for the impression cylinder to leave an enlarged gap between the two cylinders. This gap can be used to ensure that the seam connecting the ends of the strip forming the belt can pass between the two cylinders of the impression station without itself being damaged or without causing damage to the blanket on the pressure cylinder, to the impression cylinder or to a substrate passing between the two cylinders.

If the length of the belt is a whole number multiple of the circumference of the pressure cylinder, then the rotation of the belt can be timed to remain in phase with the pressure cylinder, so that the seam should always line up with the enlarged gap created by the discontinuities in the cylinders of the impression station.

If the belt should extend (or contract) then rotation of the belt and the cylinders of the impression station at the same speed will eventually result in the seam not coinciding with the enlarged gap between the pressure and impression cylinders. This problem may be avoided by varying the speed of movement of the belt relative to the surface velocity of the pressure and impression cylinders and providing powered tensioning rollers, or dancers, on opposite sides of the nip between the pressure and impression cylinders. The speed differential will result in slack building up on one side or the other of the nip between the pressure and impression cylinders and the dancers can act at times when there is an enlarged gap between the pressure and impression cylinders to advance or retard the phase of the belt, by reducing the slack on one side of the nip and increasing it on the other.

In this way, the belt can be maintained in synchronism with the pressure and impression cylinders so that the belt seam always passes through the enlarged gap between the two cylinders. Additionally, it allows ink images on the belt to always line up correctly with the desired printing position on the substrate.

In order to minimize friction between the belt and the pressure cylinder during such changing of the phase of the belt, it is desirable for rollers to be provided on the pressure cylinder in the discontinuity between the ends of the blanket.

In an alternative embodiment, the impression cylinder has no grippers (e.g. for web substrate or for sheet substrate retained on the impression cylinder by vacuum means), in which case the impression cylinder may have a continuous surface devoid of recess, restricting the need to align the seam to the discontinuity between the ends of the compressible blanket on the pressure cylinder. If additionally, the belt is seamless, the control of the synchronization between ink deposition on the belt and operation of the printing system at subsequent stations, such as illustrated in a non-limiting manner in the following detailed description, may be further facilitated.

The printing system in U.S. 61/606,913 allows duplex operation by providing two impression stations associated with the same intermediate transfer member with a perfecting mechanism between the two impression stations for turning the substrate onto its reverse side. This was made possible by allowing a section of the intermediate transfer member carrying an ink image to pass through an impression station without imprinting the ink image on a substrate. While this is possible when moving a relatively small pressure roller, or nip roller, into and out of engagement with an impression cylinder, moving the pressure cylinder of the present invention in this manner would be less convenient.

In order to permit double-sided printing using a single impression station having blanket-bearing pressure and impression cylinders that are favorably engaged permanently, a duplex mechanism is provided in an embodiment of the invention for inverting a substrate sheet that has already passed through the impression station and returning the sheet of substrate to pass a second time through the same impression station for an image to be printed onto the reverse side of the substrate sheet.

In accordance with a second aspect of the invention, there is provided a printing system comprising an image forming station at which droplets of an ink that include an organic polymeric resin and a coloring agent in an aqueous carrier are applied to an outer surface of an intermediate transfer member to form an ink image, a drying station for drying the ink image to leave a residue film of resin and coloring agent; and an impression station at which the residue film is transferred to a substrate, wherein the intermediate transfer member comprises a thin flexible substantially inextensible belt and wherein the impression station comprises an impression cylinder and a pressure cylinder having a compressible outer surface for urging the belt against the impression cylinder to cause the residue film resting on the outer surface of the belt to be transferred onto a substrate passing between the belt and the impression cylinder, the belt having a length greater than the circumference of the pressure cylinder and being guided to contact the pressure cylinder over only a portion of the length of the belt.

BRIEF DESCRIPTION OF THE DRAWINGS

The invention will now be described further, by way of example, with reference to the accompanying drawings, in which the dimensions of components and features shown in the figures are chosen for convenience and clarity of presentation and not necessarily to scale. In the drawings.

DETAILED DESCRIPTION

Figure 1:
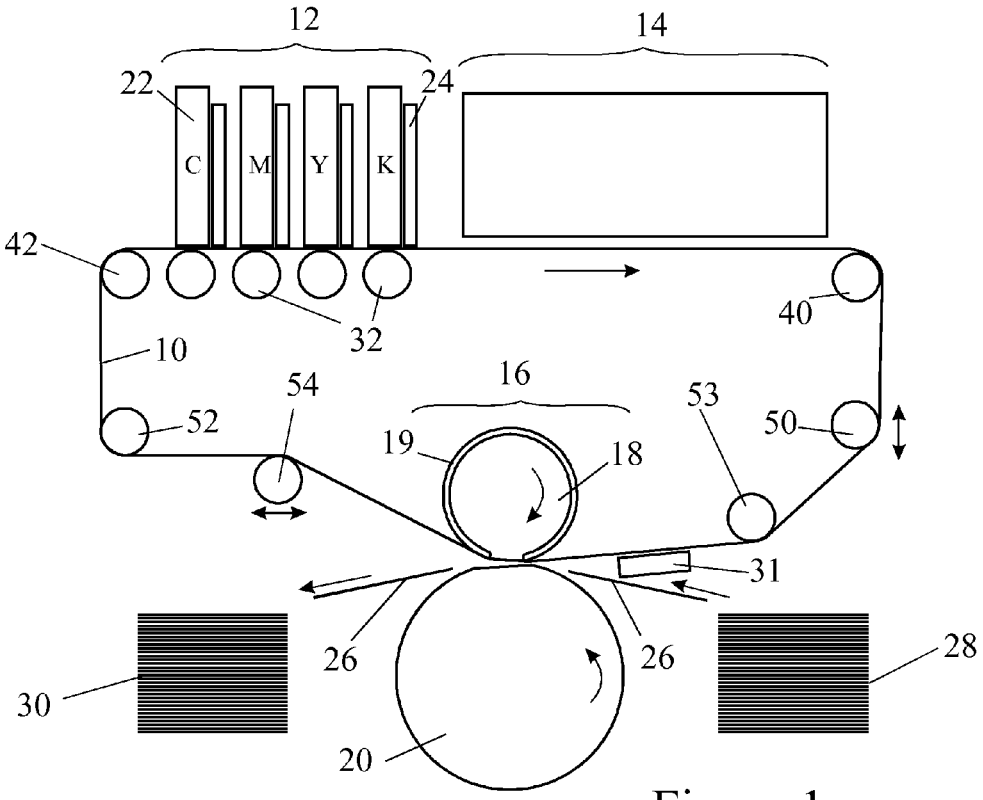
FIG. 1 is a schematic representation of a printing system of the invention.

The printing system of FIG. 1 comprises an endless belt 10 that cycles through an image forming station 12, a drying station 14, and an impression station 16.

In the image forming station 12 four separate print bars 22 incorporating one or more print heads, that use inkjet technology, deposit aqueous ink droplets of different colors onto the surface of the belt 10. Though the illustrated embodiment has four print bars each able to deposit one of the typical four different colors (namely Cyan (C), Magenta (M), Yellow (Y) and Black (K)), it is possible for the image forming station to have a different number of print bars and for the print bars to deposit different shades of the same color (e.g. various shades of grey including black) or for two print bars or more to deposit the same color (e.g. black). Following each print bar 22 in the image forming station, an intermediate drying system 24 is provided to blow hot gas (usually air) onto the surface of the belt 10 to dry the ink droplets partially. This hot gas flow assists in preventing the droplets of different color inks on the belt 10 from merging into one another.

In the drying station 14, the ink droplets on the belt 10 are exposed to radiation and/or hot gas in order to dry the ink more thoroughly, driving off most, if not all, of the liquid carrier and leaving behind only a layer of resin and coloring agent which is heated to the point of being softened. Softening of the polymeric resin may render the ink image tacky and increases its ability to adhere to the substrate as compared to its previous ability to adhere to the transfer member.

In the impression station 16, the belt 10 passes between an impression cylinder 20 and a pressure cylinder 18 that carries a compressible blanket 19. The length of the blanket 19 is equal to or greater than the maximum length of a sheet 26 of substrate on which printing is to take place. The length of the belt 10 is longer than the circumference of the pressure cylinder 18 by at least 10%, and in one embodiment considerably longer by at least 3-fold, or at least 5-fold, or at least 7-fold, or at least 10-fold, and only contacts the pressure cylinder 18 over a portion of its length. The impression cylinder 20 has twice the diameter of the pressure cylinder 18 and can support two sheets 26 of substrate at the same time. Sheets 26 of substrate are carried by a suitable transport mechanism (not shown in FIG. 1) from a supply stack 28 and passed through the nip between the impression cylinder 20 and the pressure cylinder 18. Within the nip, the surface of the belt 10 carrying the ink image, which may at this time be tacky, is pressed firmly by the blanket 19 on the pressure cylinder 18 against the substrate 26 so that the ink image is impressed onto the substrate and separated neatly from the surface of the belt. The substrate is then transported to an output stack 30. In some embodiments, a heater 31 may be provided to heat the thin surface of the release layer, shortly prior to the nip between the two cylinders 18 and 20 of the impression station, to soften the resin and to assist in rendering the ink film tacky, so as to facilitate transfer to the substrate.

In order for the ink to separate neatly from the surface of the belt 10 it is necessary for the latter surface to have a hydrophobic release layer. In co-pending PCT application No. PCT/IB2013/051716, which claims priority from U.S. Provisional Patent Application No. 61/606,913, (both of which application are herein incorporated by reference in their entirety) this hydrophobic release layer is formed as part of a thick blanket that also includes a compressible and a conformability layer which are necessary to ensure proper contact between the release layer and the substrate at the impression station. The resulting blanket is a very heavy and costly item that needs to be replaced in the event a failure of any of the many functions that it fulfills.

In the present invention, the hydrophobic release layer forms part of a separate element from the thick blanket 19 that is needed to press it against the substrate sheets 26. In FIG. 1, the release layer is formed on the flexible thin inextensible belt 10 that is preferably fiber reinforced for increased tensile strength in its lengthwise dimension, high performance fibers being particularly suitable.

Figure 4:
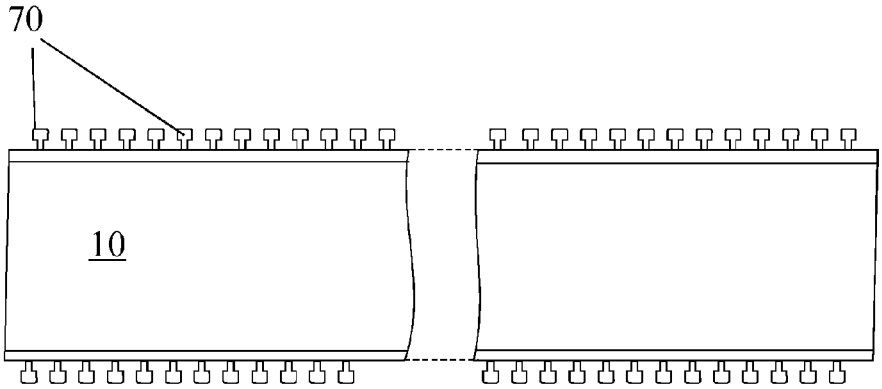
FIG. 4 is a plan view of a strip from which a belt is formed, the strip having formations along its edges to assist in guiding the belt.
Figure 5:
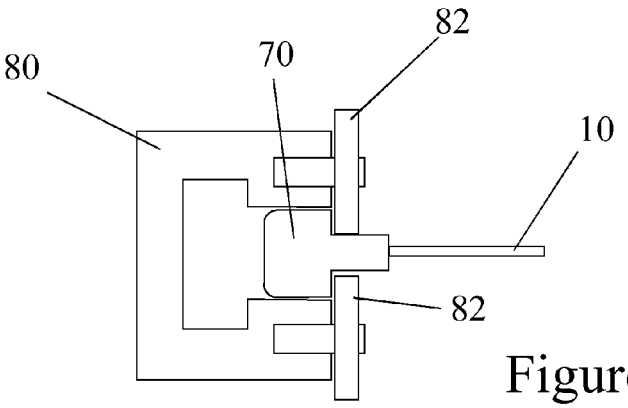
FIG. 5 is a section through a guide channel for the belt within which the formations shown in FIG. 4 are received.

As shown schematically in FIGS. 4 and 5, the lateral edges of the belt 10 are provided in some embodiments of the invention with spaced projections or formations 70 which on each side are received in a respective guide channel 80 (shown in section in FIG. 5) in order to maintain the belt taut in its widthways dimension. The formations 70 may be the teeth of one half of a zip fastener that is sewn or otherwise secured to the lateral edge of the belt. As an alternative to spaced formations, a continuous flexible bead of greater thickness than the belt 10 may be provided along each side. To reduce friction, the guide channel 80 may, as shown in FIG. 5, have rolling bearing elements 82 to retain the formations 70 or the beads within the channel 80. The formations need not be the same on both lateral edges of the belt. They can differ in shape, spacing, composition and physical properties. For example, the formation on one side may provide the elasticity desired to maintain the belt taut when the lateral formations are guided through their respective lateral channels. Though not shown in the figure, on one side of the belt the lateral formations may be secured to an elastic stripe, itself attached to the belt.

The formations may be made of any material able to sustain the operating conditions of the printing system, including the rapid motion of the belt. Suitable materials can resist elevated temperatures in the range of about 50° C. to 250° C. Advantageously, such materials are also friction resistant and do not yield debris of size and/or amount that would negatively affect the movement of the belt during its operative lifespan. For example, the lateral formations can be made of polyamide reinforced with molybdenum disulfide. Further details of non-limiting examples of formations suitable for belts that may be used in the printing systems of the present invention are disclosed in co-pending PCT Application No. PCT/IB2013/051719.

Guide channels in the image forming station ensure accurate placement of the ink droplets on the belt 10. In other areas, such as within the drying station 14 and the impression station 16, lateral guide channels are desirable but less important. In regions where the belt 10 has slack, no guide channels are present.

It is important for the belt 10 to move with constant speed through the image forming station 12 as any hesitation or vibration will affect the registration of the ink droplets of different colors. To assist in guiding the belt smoothly, friction is reduced by passing the belt over rollers 32 adjacent each printing bar 22 instead of sliding the belt over stationary guide plates. The roller 32 need not be precisely aligned with their respective print bars. They may be located slightly (e.g. few millimeters) downstream of the print head jetting location. The frictional forces maintain the belt taut and substantially parallel to print bars. The underside of the belt may therefore have high frictional properties as it is only ever in rolling contact with all the surfaces on which it is guided. The lateral tension applied by the guide channels need only be sufficient to maintain the belt 10 flat and in contact with rollers 32 as it passes beneath the print bars 22. Aside from the inextensible reinforcement/support layer, the hydrophobic release surface layer and high friction underside, the belt 10 is not required to serve any other function. It may therefore be a thin light inexpensive belt that is easy to remove and replace, should it become worn.

To achieve intimate contact between the hydrophobic release layer and the substrate, the belt 10 passes through the impression station 16 which comprises the impression and pressure cylinders 20 and 18. The replaceable blanket 19 releasably clamped onto the outer surface of the pressure cylinder 18 provides the conformability required to urge the release layer of the belt 10 into contact with the substrate sheets 26. Rollers 53 on each side of the impression station ensure that the belt is maintained in a desired orientation as it passes through the nip between the cylinders 18 and 20 of the impression station 16.

As explained in U.S. 61/606,913, temperature control is of paramount importance to the printing system if printed images of high quality are to be achieved. This is considerably simplified in the present invention in that the thermal capacity of the belt is much lower than that of an intermediate transfer member that also incorporated the felt or sponge-like compressible layer. U.S. 61/606,913 also proposed additional layers affecting the thermal capacity of the blanket that were intentionally inserted in view of the blanket being heated from beneath. The separation of the belt 10 from the blanket 19 allows the temperature of the ink droplets to be dried and heated to the softening temperature of the resin using much less energy in the drying station 14. Furthermore, the belt may cool down before it returns to the image forming station which reduces or avoids problems caused by trying to spray ink droplets on a hot surface running very close to the inkjet nozzles. Alternatively and additionally, a cooling station may be added to the printing system to reduce the temperature of the belt to a desired value before the belt enters the image forming station.

Though as explained the temperature at various stage of the printing process may vary depending on the type of the belt and inks being used and may even fluctuate at various locations along a given station, in some embodiments of the invention the temperature on the outer surface of the intermediate transfer member at the image forming station is in a range between 40° C. and 160° C., or between 60° C. and 90° C. In some embodiments of the invention, the temperature at the dryer station is in a range between 90° C. and 300° C., or between 150° C. and 250° C., or between 200° C. and 225° C. In some embodiments, the temperature at the impression station is in a range between 80° C. and 220° C., or between 100° C. and 160° C., or of about 120° C., or of about 150° C. If a cooling station is desired to allow the transfer member to enter the image forming station at a temperature that would be compatible to the operative range of such station, the cooling temperature may be in a range between 40° C. and 90° C.

In some embodiments of the invention, the release layer of the belt 10 has hydrophobic properties to ensure that the ink residue image, which can be rendered tacky, peels away from it cleanly in the impression station. However, at the image forming station the same hydrophobic properties are undesirable because aqueous ink droplets can move around on a hydrophobic surface and, instead of flattening on impact to form droplets having a diameter that increases with the mass of ink in each droplet, the ink tends to ball up into spherical globules. In embodiments with a release layer having a hydrophobic outer surface, steps therefore need to be taken to encourage the ink droplets first to flatten out into a disc on impact then to retain their flattened shape during the drying and transfer stages.

To achieve this objective, it is desirable for the liquid ink to comprise a component chargeable by Brønsted-Lowry proton transfer, to allow the liquid ink droplets to acquire a charge subsequent to contact with the outer surface of the belt by proton transfer so as to generate an electrostatic interaction between the charged liquid ink droplets and an opposite charge on the outer surface of the belt. Such an electrostatic charge will fix the droplets to the outer surface of the belt and resist the formation of spherical globule. Ink compositions are typically negatively charged.

The Van der Waals forces resulting from the Brønsted-Lowry proton transfer may result either from an interaction of the ink with a component forming part of the chemical composition of the release layer, such as amino silicones, or with a treatment solution, such as a high charge density PEI (polyethyleneimine), that is applied to the surface of the belt 10 prior to its reaching the image forming station 12 (e.g. if the treated belt has a release layer comprising silanol-terminated polydialkylsiloxane silicones).

Without wishing to be bound by a particular theory, it is believed that upon evaporation of the ink carrier, the reduction of the aqueous environment lessens the respective protonation of the ink component and of the release layer or treatment solution thereof, thus diminishing the electrostatic interactions therebetween allowing the dried ink image to peel off from the belt upon transfer to substrate.

It is possible for the belt 10 to be seamless, that is it to say without discontinuities anywhere along its length. Such a belt would considerably simplify the control of the printing system as it may be operated at all times to run at the same surface velocity as the circumferential velocity of the two cylinders 18 and 20 of the impression station. Any stretching of the belt with ageing would not affect the performance of the printing system and would merely require the taking up of more slack by tensioning rollers 50 and 54, detailed below.

It is however less costly to form the belt as an initially flat strip of which the opposite ends are secured to one another, for example by a zip fastener or possibly by a strip of hook and loop tape or possibly by soldering the edges together or possibly by using tape (e.g. Kapton® tape, RTV liquid adhesives or PTFE thermoplastic adhesives with a connective strip overlapping both edges of the strip). In such a construction of the belt, it is essential to ensure that printing does not take place on the seam and that the seam is not flattened against the substrate 26 in the impression station 16.

The impression and pressure cylinders 18 and 20 of the impression station 16 may be constructed in the same manner as the blanket and impression cylinders of a conventional offset litho press. In such cylinders, there is a circumferential discontinuity in the surface of the pressure cylinder 18 in the region where the two ends of the blanket 19 are clamped. There can also be discontinuities in the surface of the impression cylinder which accommodate grippers that serve to grip the leading edges of the substrate sheets to help transport them through the nip. In the illustrated embodiments of the invention, the impression cylinder circumference is twice that of the pressure cylinder and the impression cylinder has two sets of grippers, so that the discontinuities line up twice every cycle for the impression cylinder.

If the belt 10 has a seam, then it is necessary to ensure that the seam should always coincides in time with the gap between the cylinders of the impression station 16. For this reason, it is desirable for the length of the belt 10 to be equal to a whole number multiple of the circumference of the pressure cylinder 18.

However, even if the belt has such a length when new, its length may change during use, for example with fatigue or temperature, and should that occur the phase of the seam during its passage through the nip of the impression station will change every cycle.

To compensate for such change in the length of the belt 10, it may be driven at a slightly different speed from the cylinders of the impression station 16. The belt 10 is driven by two rollers 40 and 42. By applying different torques through the rollers 40 and 42 driving the belt, the run of the belt passing through the image forming station is maintained under controlled tension. In some embodiments, the rollers 40 and 42 are powered separately from the cylinders of the impression station 16, allowing the surface velocity of the two rollers 40 and 42 to be set differently from the surface velocity of the cylinders 18 and 20 of the impression station 16.

Of the various rollers 50, 52, 53 and 54 over which the belt is guided, two are powered tensioning rollers, or dancers, 50 and 54 which are provided one on each side of the nip between the cylinders of the impression station. These two dancers 50, 54 are used to control the length of slack in the belt 10 before and after the nip and their movement is schematically represented by double sided arrows adjacent the respective dancers.

If the belt 10 is slightly longer than a whole number multiple of the circumference of the pressure cylinder then if in one cycle the seam does align with the enlarged gap between the cylinders 18 and 20 of the impression station then in the next cycle the seam will have moved to the right, as viewed in FIG. 1. To compensate for this, the belt is driven faster by the rollers 40 and 42 so that slack builds up to the right of the nip and tension builds up to the left of the nip. To maintain the belt 10 at the correct tension, the dancer 50 is moved down and at the same time the dancer 54 is moved to the left. When the discontinuities of the cylinders of the impression station face one another and a gap is created between them, the dancer 54 is moved to the right and the dancer 50 is moved up to accelerate the run of the belt passing through the nip and bring the seam into the gap. Though the dancers 50 and 54 are schematically shown in FIG. 1 as moving vertically and horizontally, respectively, this need not be the case and each dancer may move along any direction as long as the displacement of one with respect to the other allows the suitable acceleration or deceleration of the belt enabling the desired alignment of the seam.

Figure 3:
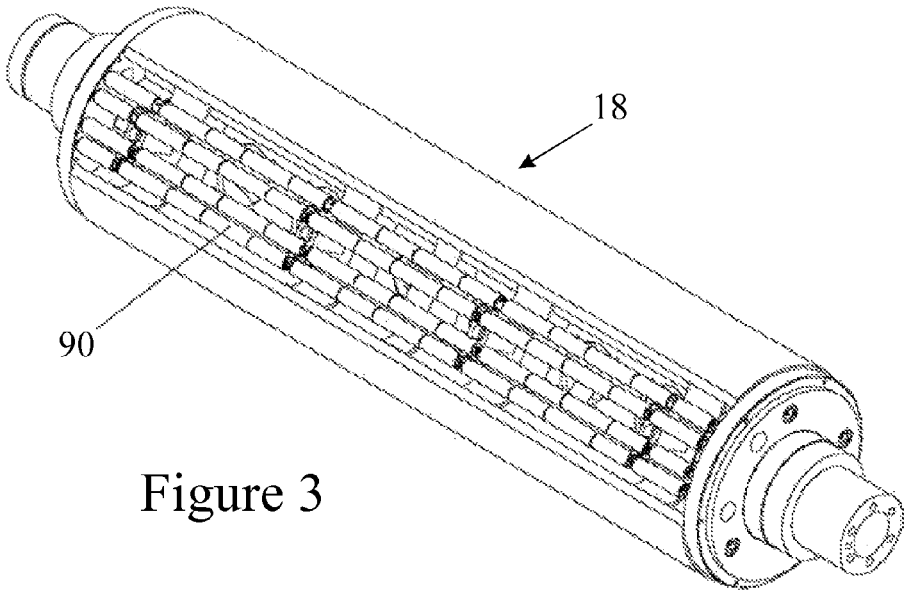
FIG. 3 is a perspective view of a pressure cylinder having rollers within the discontinuity between the ends of the blanket.

To reduce the drag on the belt 10 as it is accelerated through the nip, the pressure cylinder 18 may, as shown in FIG. 3, be provided with rollers 90 within the discontinuity region between the ends of the blanket.

The need to correct the phase of the belt in this manner may be sensed either by measuring the length of the belt 10 or by monitoring the phase of one or more markers on the belt relative to the phase of the cylinders of the impression station. The marker(s) may for example be applied to the surface of the belt and may be sensed magnetically or optically by a suitable detector. Alternatively, a marker may take the form of an irregularity in the lateral formations that are used to tension the belt, for example a missing tooth, hence serving as a mechanical position indicator.

Figure 2:
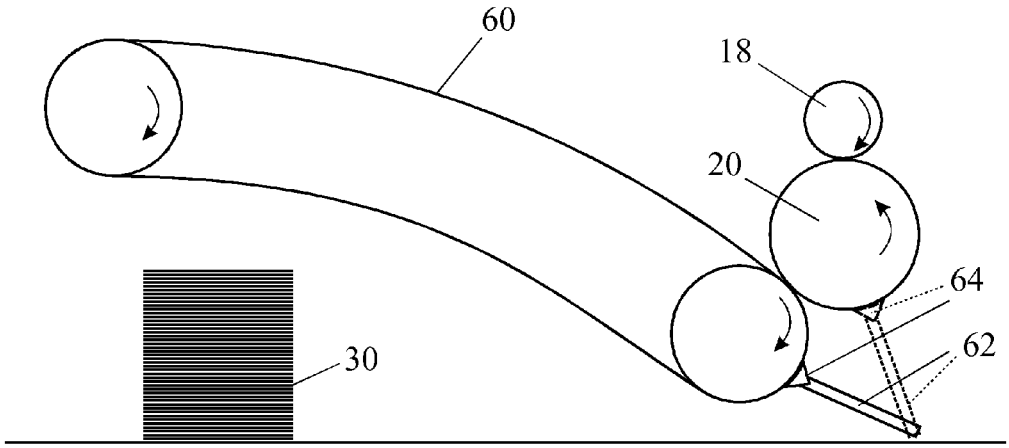
FIG. 2 is a schematic representation of a duplexing mechanism.

FIG. 2 shows the principle of operation of a duplex mechanism to allow the same sheet of substrate to pass twice through the nip of the same impression station, once face up and once face down.

In FIG. 2, after impression of an image on a sheet of substrate, it is picked off the impression cylinder 20 by a discharge conveyor 60 and eventually dropped onto the output stack 30. If a sheet is to have a second image printed on its reverse side, then it may be removed from the conveyor 60 by means of a pivoting arm 62 that carries suckers 64 at its free end. The sheet of substrate will at this time be positioned on the conveyor 60 with its recently printed surface facing away from the suckers 64 so that no impression of the suckers will be left on the substrate.

Having picked a sheet of substrate off the conveyor 60, the pivoting arm 62 pivots to the position shown in dotted lines and will offer what was previously the trailing edge of the sheet to the grippers of the impression cylinder. The feed of sheets of substrates from the supply stack will in this duplex mode of operation be modified so that in alternate cycles the impression cylinder will receive a sheet from the supply stack 28 then from the discharge conveyor 60. The station where substrate side inversion takes place may be referred hereinafter as the duplexing or perfecting station.

Printing systems of the invention may be used to print on web substrates as well as sheet substrates, as described above. In web printing systems, there are no grippers on the impression cylinder and there need not be a gap between the ends of blanket wrapped around the pressure cylinder. Instead, the pressure cylinder may be formed with an outer made of a suitable compressible material.

To print on both sides of a web, two separate printing systems may be provided, each having its own print heads, intermediate transfer member, pressure cylinder and impression cylinder. The two printing systems may be arranged in series with a web reversing mechanism between them.

In an alternative embodiment, a double width printing systems may be used, this being equivalent to two printing systems arranged in parallel rather than in series with one another. In this case, the intermediate transfer member, the print bars, and the impression station are all at least twice as wide as the web and different images are printed by the two halves of the printing system straddling the centerline. After having passed down one side of the printing system, the web is inverted and returned to enter the printing system a second time in the same direction but on the other side of the printing system for images to be printed on its reverse side.

When printing on a web, powered dancers may be needed to position the web for correct alignment of the printing on opposite sides of the web and to reduce the empty space between printed images on the web.

The above description is simplified and provided only for the purpose of enabling an understanding of the present invention. For a successful printing system, the physical and chemical properties of the inks, the chemical composition and possible treatment of the release surface of the belt 10 and the control of the various stations of the printing system are all important but need not be considered in detail in the present context.

Such aspects are described and claimed in other applications of the same Applicant which have been filed or will be filed at approximately the same time as the present application. Further details on aqueous inks that may be used in a printing system according to the present invention are disclosed in PCT application No. PCT/IB2013/051755. Belts and release layers thereof that would be suitable for such inks are disclosed in PCT applications No. PCT/IB2013/051743 and No. PCT/IB2013/051751. The elective pre-treatment solution can be prepared according to the disclosure of PCT application No. PCT/IB2013/000757. Appropriate belt structures and methods of installing the same in a printing system according to the invention are detailed in PCT application No. PCT/IB2013/051719, while exemplary methods for controlling such systems are provided in PCT application No. PCT/IB2013/051727. Additionally, the operation of the present printing system may be monitored through displays and user interface as described in co-pending PCT application No. PCT/IB2013/050245.

The contents of all of the above mentioned applications of the Applicant are incorporated by reference as if fully set forth herein.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise", "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" or "at least one impression station" may include a plurality of impression stations.

The invention claimed is:

1. A printing system comprising an image forming station at which droplets of an ink that includes an organic polymer resin and a coloring agent in an aqueous carrier are applied to an outer surface of an intermediate transfer member to form an ink image, a drying station for drying the ink image to leave an ink residue film; and an impression station at which the residue film is transferred to a sheet or web substrate wherein the intermediate transfer member comprises a thin flexible endless substantially inextensible belt and wherein the impression station comprises an impression cylinder located outside of the belt and facing an outer surface thereof and a pressure cylinder encircled by the endless belt, the pressure cylinder carrying a compressible blanket mounted around only a portion of the circumference of the pressure cylinder so that opposite ends of the compressible blanket are spaced from one another by a gap, the pressure cylinder being configured to urge the belt against the impression cylinder with sufficient force to cause the residue film resting on the outer surface of the belt to be transferred onto the substrate that passes between the belt and the impression cylinder, the belt having a length greater than the circumference of the pressure cylinder and being guided to contact the pressure cylinder over only a portion of the length of the belt wherein the compressible outer surface of the pressure cylinder causes the outer surface of the belt to conform to the opposing surface of the substrate for an effective transfer of the ink residue film onto the substrate.

2. A printing system as claimed in claim 1, wherein the belt is driven independently of the pressure cylinder.

3. A printing system as claimed in claim 1, wherein slack runs of the belt are provided between the impression station and the image forming station to isolate the image forming station from any vibration imposed on the movement of the belt while passing through the impression station.

4. A printing system as claimed in claim 1, wherein (i) the belt comprises a support layer and a release layer; (ii) the support layer is made of a fabric that is fiber-reinforced at least in the longitudinal direction of the belt, said fiber being a high performance fiber selected from the group comprising aramid, carbon, ceramic, and glass fibers, and (iii) the belt is substantially inextensible in the longitudinal direction of the belt but has limited lateral elasticity to assist in maintaining the belt taut and flat in the image forming station.

5. A printing system as claimed in claim 1, wherein (i) longitudinally spaced formations, or a thick continuous flexible bead, are/is provided along each of the two lateral edges of the belt, the beads or formations being engaged in lateral guide channels extending at least over the run of the belt passing through the image forming station; and (ii) guide channels are further provided to guide the run of the belt passing through the impression station.

6. A printing system as claimed in claim 5, wherein the lateral formations are formed by the teeth of one half of a zip fastener sewn, or otherwise secured, to each lateral edge of the belt, through an intermediate lateral elastic strip.

7. A printing system as claimed in claim 1, wherein the belt is formed by a flat elongate strip of which the ends are secured to one another at a seam to form a continuous loop.

8. A printing system as claimed in claim 1, wherein a duplexing mechanism is provided for inverting a substrate sheet that has already passed through the impression station and returning the sheet of substrate to pass a second time through the same impression station for an image to be printed onto the reverse side of the substrate sheet.

9. A printing system as claimed in claim 1, wherein the substrate is a web having no more than half the width of the intermediate transfer member and of the impression station and configured to make a first pass through one side the impression station to receive a printed image on one side and subsequently, after inversion, to make a second pass through the other side of the impression station to receive a printed image on the reverse side.

10. The system of claim 1 wherein: (i) the system is configured to handle and print on substrate sheets so that, at the impression station the residue film is transferred to a substrate sheet of at least a predetermined length; and (ii) the compressible blanket is at least as long as the predetermined length of the substrate sheets.

11. The system of claim 1 wherein the compressible blanket is detachably mounted to the surface of the pressure cylinder.

12. The system of claim 1 further comprising a plurality of rollers mounted on the pressure cylinder within the gap defined by the compressible blanket.

13. A printing system comprising an image forming station at which droplets of an ink that includes an organic polymer resin and a coloring agent in an aqueous carrier are applied to an outer surface of an intermediate transfer member to form an ink image, a drying station for drying the ink image to leave an ink residue film; and an impression station at which the residue film is transferred to a sheet or web substrate wherein the intermediate transfer member comprises a thin flexible endless substantially inextensible belt and wherein the impression station comprises an impression cylinder located outside of the belt and facing an outer surface thereof and a pressure cylinder encircled by the endless belt, the pressure cylinder carrying a compressible blanket that is detachably mounted to the pressure cylinder, the pressure cylinder being configured to urge the belt against the impression cylinder with sufficient force to cause the residue film resting on the outer surface of the belt to be transferred onto the substrate that passes between the belt and the impression cylinder, the belt having a length greater than the circumference of the pressure cylinder and being guided to contact the pressure cylinder over only a portion of the length of the belt wherein the compressible outer surface of the pressure cylinder causes the outer surface of the belt to conform to the opposing surface of the substrate for an effective transfer of the ink residue film onto the substrate.

14. A printing system as claimed in claim 13, wherein the pressure cylinder comprises a support cylinder and the compressible blanket covers less than the entire circumference of the support cylinder to leave a discontinuity between the ends of the blanket, wherein the impression cylinder has at least one discontinuity for accommodating grippers or vacuum means serving to hold sheets of substrate in position against the impression cylinder, wherein the pressure cylinder and the impression cylinder are rotated in synchronism so that the two discontinuities line up with one another during rotation of the cylinders to leave an enlarged gap between the two cylinders and wherein the belt is driven in such a manner that the seam connecting the ends of the strip forming the belt is timed to pass between the two cylinders of the impression station only when discontinuities in the pressure cylinder and the impression cylinder are aligned with one another.

15. A printing system as claimed in claim 14, wherein the timing of the passage of the seam between the pressure and impression cylinders is modified by varying the speed of movement of a section of the belt relative to the surface velocity of the pressure and impression cylinders at times when discontinuities in the pressure cylinder and the impression cylinder are aligned with one another.

16. A printing system as claimed in claim 15, wherein the speed of the belt is varied by providing powered dancers on opposite sides of the nip between the pressure and impression cylinders.

17. A printing system as claimed in claim 14, wherein, in order to minimize friction between the belt and the pressure cylinder during changing of the phase of the belt, rollers are provided on the pressure cylinder in the discontinuity between the ends of the blanket.

18. The system of claim 13 wherein: (i) the system is configured to handle and print on substrate sheets so that, at the impression station the residue film is transferred to a substrate sheet of at least a predetermined length; and (ii) the compressible blanket is at least as long as the predetermined length of the substrate sheets.

19. A printing system as claimed in claim 13, wherein the belt is driven independently of the pressure cylinder.

20. A printing system as claimed in claim 13, wherein slack runs of the belt are provided between the impression station and the image forming station to isolate the image forming station from any vibration imposed on the movement of the belt while passing through the impression station.

* * * * *